US010854382B2

(12) United States Patent
Kuribayashi et al.

(10) Patent No.: US 10,854,382 B2
(45) Date of Patent: Dec. 1, 2020

(54) METHOD FOR PRODUCING RARE-EARTH MAGNETS, AND SLURRY APPLICATION DEVICE

(71) Applicant: SHIN-ETSU CHEMICAL CO., LTD., Tokyo (JP)

(72) Inventors: Yukihiro Kuribayashi, Echizen (JP); Shogo Kamiya, Echizen (JP); Harukazu Maegawa, Echizen (JP); Shintaro Tanaka, Echizen (JP)

(73) Assignee: SHIN-ETSU CHEMICAL CO., LTD., Tokyo (JP)

( * ) Notice: Subject to any disclaimer, the term of this patent is extended or adjusted under 35 U.S.C. 154(b) by 212 days.

(21) Appl. No.: 15/569,881

(22) PCT Filed: Apr. 18, 2016

(86) PCT No.: PCT/JP2016/062212
§ 371 (c)(1),
(2) Date: Oct. 27, 2017

(87) PCT Pub. No.: WO2016/175067
PCT Pub. Date: Nov. 3, 2016

(65) Prior Publication Data

US 2018/0122572 A1 May 3, 2018

(30) Foreign Application Priority Data

Apr. 28, 2015 (JP) ..... 2015-092050

(51) Int. Cl.
*H01F 41/02* (2006.01)
*B22F 3/00* (2006.01)
(Continued)

(52) U.S. Cl.
CPC ..... *H01F 41/0293* (2013.01); *B05C 3/10* (2013.01); *B05C 13/02* (2013.01); *B05D 5/12* (2013.01);
(Continued)

(58) Field of Classification Search
CPC .. H01F 41/00; H01F 41/0253; H01F 41/0293; H01F 41/309; H01F 41/16; H01F 41/026; H01F 1/053; H01F 1/0536
(Continued)

(56) References Cited

U.S. PATENT DOCUMENTS 7,531,933 B2 5/2009 Miyata et al.
7,559,996 B2 7/2009 Miyata et al.
(Continued)

FOREIGN PATENT DOCUMENTS

JP 62-77688 U 5/1987
JP 2002-220675 * 8/2002
(Continued)

OTHER PUBLICATIONS

International Search Report, issued in PCT/JP2016/062212 (PCT/ISA/210), dated Jul. 12, 2016.
(Continued)

*Primary Examiner* — Tabassom Tadayyon Eslami
(74) *Attorney, Agent, or Firm* — Birch, Stewart, Kolasch & Birch, LLP

(57) ABSTRACT

When a slurry in which a rare-earth-compound powder is dispersed is applied to sintered magnet bodies 1 and dried to apply the powder thereto, the sintered magnet bodies 1 are conveyed by a conveyer 2 and made to pass through the slurry 4 to apply the slurry to the sintered magnet bodies 1. Furthermore, a plurality of push-up members 51, which pass through insertion holes 22 provided in a conveyor belt 21, and protrude above the conveyor belt, are used to tempo-
(Continued)

rarily push up the sintered magnet bodies 1, and temporarily separate the conveyor belt 21 and the sintered magnet bodies 1. As a result, the slurry can be efficiently applied, even mass production can be suitably dealt with, and the slurry can be uniformly and reliably applied to the entire surface of each of the sintered magnet bodies.

6 Claims, 1 Drawing Sheet

(51) Int. Cl.

| | |
|---|---|
| ***B05C 3/10*** | (2006.01) |
| ***B05C 13/02*** | (2006.01) |
| ***B05D 5/12*** | (2006.01) |
| ***B22F 3/24*** | (2006.01) |
| ***H01F 1/057*** | (2006.01) |
| ***C22C 38/00*** | (2006.01) |
| ***B22F 9/04*** | (2006.01) |
| ***H01F 1/053*** | (2006.01) |
| ***H01F 1/08*** | (2006.01) |
| *B05D 1/18* | (2006.01) |

(52) U.S. Cl.
CPC ..... *B22F 3/00* (2013.01); *B22F 3/24* (2013.01); *B22F 9/04* (2013.01); *C22C 38/002* (2013.01); *C22C 38/005* (2013.01); *H01F 1/0536* (2013.01); *H01F 1/0577* (2013.01); *H01F 1/086* (2013.01); *B05D 1/18* (2013.01); *B05D 2401/10* (2013.01); *B05D 2401/32* (2013.01); *B22F 2998/10* (2013.01); *B22F 2999/00* (2013.01)

(58) Field of Classification Search
USPC ..... 427/127, 128, 129, 130, 131, 132, 601, 427/594; 428/822.3, 822.5; 118/427, 118/428
See application file for complete search history.

(56) References Cited

U.S. PATENT DOCUMENTS

| | | | | |
|---|---|---|---|---|
| 8,377,233 | B2 | 2/2013 | Nakamura et al. | |
| 2011/0150691 | A1* | 6/2011 | Nakamura ..... | B22F 9/023 419/13 |
| 2015/0086710 | A1 | 3/2015 | Takagi | |

FOREIGN PATENT DOCUMENTS

| | | | |
|---|---|---|---|
| JP | 2002-220675 | A | 8/2002 |
| JP | 2007-53351 | A | 3/2007 |
| JP | 2008-61333 | A | 3/2008 |
| JP | 2008-274420 | A | 11/2008 |
| JP | 2011-129871 | A | 6/2011 |
| JP | 2015-65218 | A | 4/2015 |
| WO | WO 2006/043348 | A1 | 4/2006 |

OTHER PUBLICATIONS

Written Opinion of the International Searching Authority, issued in PCT/JP2016/062212 (PCT/ISA/237), dated Jul. 12, 2016.

* cited by examiner

METHOD FOR PRODUCING RARE-EARTH MAGNETS, AND SLURRY APPLICATION DEVICE

TECHNICAL FIELD

This invention relates to a method for producing rare earth magnet by applying a slurry of a rare earth compound-containing powder in a solvent to a sintered magnet body and drying to coat the magnet body with the powder and heat treating for causing the rare earth element to be absorbed in the magnet body, wherein the rare earth compound powder is uniformly and efficiently coated and rare earth magnet having excellent magnetic properties is efficiently produced and a slurry application device suited for use in the rare earth magnet producing method.

BACKGROUND ART

Rare earth permanent magnets including Nd—Fe—B base magnets find an ever spreading application owing to their excellent magnetic properties. Methods known in the art for further improving the coercivity of these rare earth magnets include a method for producing a rare earth permanent magnet by coating the surface of a sintered magnet body with a rare earth compound powder, and heat treating the coated body for causing the rare earth element to be absorbed and diffused in the sintered magnet body (Patent Document 1: JP-A 2007-053351, Patent Document 2: WO 2006/043348). This method is successful in increasing coercivity while suppressing any decline of remanence.

Patent Document 3: JP-A 2008-061333 discloses that when the above method is applied to a selected region of sintered magnet, the desired effect is exerted only at the applied region. This inversely means that if a portion of magnet is not fully coated with the powder, the desired effect is not available at that portion. Therefore, it is important that the selected region or the entire surface of magnet be uniformly coated with the powder before the absorptive diffusion treatment is performed.

The method for coating a magnet body on its surface with a powder includes a method of applying a slurry of the powder in a solvent and drying. As the method of applying the slurry, Patent Document 4: JP-A 2011-129871 proposes a method of spraying the slurry to the sintered magnet body while rotating the magnet body. This method, however, is quite cumbersome and utterly inadequate as the mass production method for the following reason. A sintered magnet body is set and held between a pair of jigs, which are driven for rotation. The slurry is sprayed to the magnet body while the magnet body is rotated at a predetermined speed. When it is desired that coating treatment is performed on a plurality of sintered magnet bodies, usually a sintered magnet body is manually mounted on the jigs, rotated and coated with the slurry by spraying, after which the coated magnet body is manually demounted from the shaft and recovered, a next magnet body is mounted, and similar operation is repeated.

It is thus desired to develop a method capable of uniformly and efficiently coating a slurry having a rare earth compound powder dispersed therein, controlling the coating weight, forming a dense powder coating in tight bond, facilitating mass production, and achieving a power saving.

PRIOR ART DOCUMENTS

Patent Documents

Patent Document 1: JP-A 2007-053351
Patent Document 2: WO 2006/043348

Patent Document 3: JP-A 2008-061333
Patent Document 4: JP-A 2011-129871

SUMMARY OF THE INVENTION

Problems to be Solved by the Invention

An object of the invention, which is made under the above circumstances, is to provide a method for producing rare earth magnet comprising the steps of applying a slurry of a powder in a solvent to sintered magnet bodies of $R^1$—Fe—B composition (wherein $R^1$ is one or more elements selected from Y, Sc and rare earth elements), the powder containing one or more compounds selected from an oxide, fluoride, oxyfluoride, hydroxide and hydride of $R^2$ (wherein $R^2$ is one or more elements selected from Y, Sc and rare earth elements), drying the slurry to coat the magnet body with the powder, and heat treating the coated magnet body, the method being capable of uniformly and efficiently coating the slurry to uniformly and efficiently coat the magnet body with the powder, controlling the coating weight, forming a dense powder coating in tight bond, and producing rare earth magnet with improved magnetic properties efficiently; and a slurry application device suited for use in the rare earth magnet producing method.

Means for Solving the Problems

To attain the above object, the invention provides a method for producing rare earth magnet as defined below as [1] to [4].

[1] A method for producing rare earth magnet comprising the steps of applying a slurry of a powder in a solvent to a sintered magnet body of $R^1$—Fe—B composition (wherein $R^1$ is one or more elements selected from Y, Sc and rare earth elements), the powder containing one or more compounds selected from an oxide, fluoride, oxyfluoride, hydroxide and hydride of $R^2$ (wherein $R^2$ is one or more elements selected from Y, Sc and rare earth elements), drying the slurry to coat the sintered magnet body with the powder, and heat treating the coated magnet body for causing $R^2$ to be absorbed in the sintered magnet body, the method further comprising the steps of:

conveying the sintered magnet body by a conveyor so as to pass through the slurry, for thereby immersing the sintered magnet body in the slurry and applying the slurry to the sintered magnet body, and temporarily pushing up the sintered magnet body on a conveyor belt during the immersion duration, by a plurality of column or rod-like push-up members which protrude above the conveyor belt through insertion holes perforated in the conveyor belt, for thereby temporarily separating the sintered magnet body from the conveyor belt.

[2] The rare earth magnet producing method of [1] wherein the conveyor belt is a mesh belt.

[3] The rare earth magnet producing method of [1] or [2] wherein the push-up member is a thin rod having a diameter of 0.5 to 5 mm.

[4] The rare earth magnet producing method of any one of [1] to [3], further comprising the step of conveying the sintered magnet body which has passed though the slurry and had the slurry applied thereto, as such by the conveyor so as to pass through a residual droplet removing zone and a drying zone in sequence for thereby removing any residual droplets on the sintered magnet body surface and drying.

To attain the above object, the invention also provides a slurry application device as defined below as [5] to [10].

[5] A device for applying a slurry to sintered magnet bodies when rare earth permanent magnet is produced by applying a slurry of a powder in a solvent to sintered magnet bodies of $R^1$—Fe—B composition (wherein $R^1$ is one or more elements selected from Y, Sc and rare earth elements), the powder containing one or more compounds selected from an oxide, fluoride, oxyfluoride, hydroxide and hydride of $R^2$ (wherein $R^2$ is one or more elements selected from Y, Sc and rare earth elements), drying the slurry to coat the sintered magnet bodies with the powder, and heat treating the coated bodies for causing $R^2$ to be absorbed in the sintered magnet bodies, the device comprising a coating tank for containing the slurry, a conveyor belt perforated with a plurality of insertion holes, the conveyor belt being arranged such that a portion of the conveyor belt passes through the slurry in the coating tank, the sintered magnet body being rested on the conveyor belt and conveyed thereby, a push-up belt disposed in the coating tank and below the conveyor belt, and adapted to turn synchronous with the conveyor belt, and a plurality of column or rod-like push-up members which are mounted to the push-up belt for vertical motion, and which are adapted to temporarily move up from below the conveyor belt, penetrate through the insertion holes, and protrude above the conveyor belt, wherein the sintered magnet body is rested on the conveyor belt of the conveyor and conveyed thereby, the sintered magnet body is passed through the slurry in the coating tank, whereby the sintered magnet body is immersed in the slurry and coated with the slurry, the sintered magnet body on the conveyor belt is temporarily pushed up during the immersion duration by protruding the push-up members above the conveyor belt through the insertion holes, for thereby temporarily separating the sintered magnet body from the conveyor belt.

[6] The slurry application device of [5], further comprising a cam member disposed below the push-up belt and having a cam surface in sliding contact with the lower end of the push-up members, the cam surface pushes up the push-up members so as to penetrate through the insertion holes in the conveyor belt and protrude above the conveyor belt.

[7] The slurry application device of [5] or [6] wherein the push-up belt is driven for rotation by the conveyor belt of the conveyor via the push-up members which have penetrated into the insertion holes.

[8] The slurry application device of any one of [5] to [7] wherein the conveyor belt is a mesh belt.

[9] The slurry application device of any one of [5] to [8] wherein the push-up member is a thin rod having a diameter of 0.5 to 5 mm.

[10] The slurry application device of any one of [5] to [9] wherein the push-up belt is provided with a plurality of rib or blade-shaped agitators, and the slurry is agitated by the agitators as the push-up belt turns.

That is, in the producing method and application device of the invention, sintered magnet bodies are conveyed by a conveyor and passed through a slurry having a rare earth compound powder dispersed therein, whereby the magnet bodies are immersed in and coated with the slurry. During the immersion duration, the magnet bodies are pushed up by push-up members for thereby temporarily separating the magnet bodies apart from the conveyor belt so that the magnet bodies are properly and effectively coated over their entire surfaces with the slurry.

Advantageous Effects of the Invention

Since a plurality of sintered magnet bodies are conveyed by a conveyor and continuously coated with a slurry, the invention is capable of efficient slurry application and amenable to mass production. When the sintered magnet bodies are immersed in the slurry and coated therewith, the sintered magnet bodies are temporarily pushed up. The immersion coating is performed while the sintered magnet bodies are separated apart from the conveyor belt, so that the sintered magnet bodies are properly coated over their entire surfaces with the slurry. Accordingly, the invention can form a uniform dense powder coating in tight bond and is highly efficient and good in mass production.

In addition, according to the producing method and application device of the invention, the sintered magnet bodies are uniformly coated over the entire surfaces with the rare earth compound powder and the coating step is carried out quite efficiently. Rare earth magnet having improved magnetic properties including a fully increased coercivity can be efficiently produced.

BRIEF DESCRIPTION OF THE DIAGRAMS

EMBODIMENT FOR CARRYING OUT THE INVENTION

Figure 1:
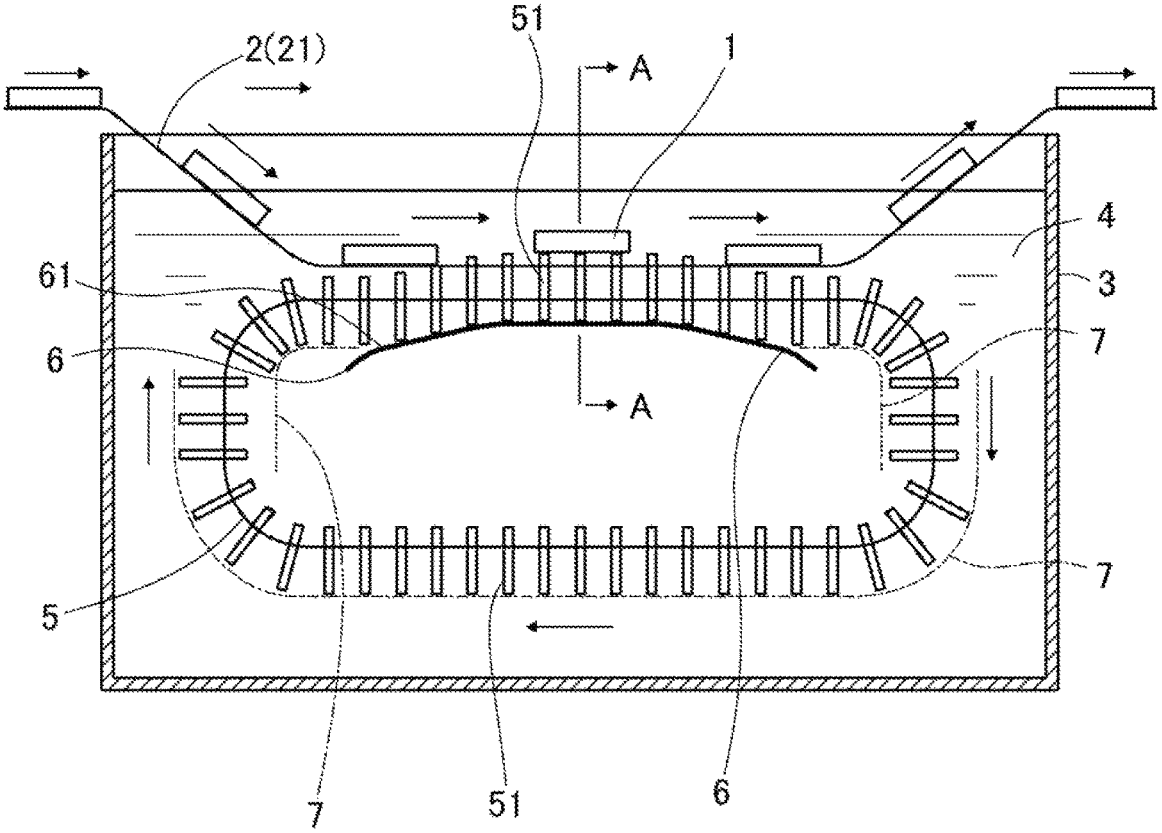
FIG. 1 is a schematic view showing an application device in one embodiment of the invention.

As described above, the method for producing rare earth magnet according to the invention includes the steps of applying a slurry of a powder in a solvent to sintered magnet bodies of $R^1$—Fe—B composition (wherein $R^1$ is one or more elements selected from Y, Sc and rare earth elements), the powder containing one or more compounds selected from an oxide, fluoride, oxyfluoride, hydroxide and hydride of $R^2$ (wherein $R^2$ is one or more elements selected from Y, Sc and rare earth elements), drying the slurry to coat the magnet bodies with the powder, and heat treating the coated magnet bodies for causing $R^2$ to be absorbed in the magnet bodies.

The $R^1$—Fe—B sintered magnet body used herein may be one obtained by any well-known method. For example, a sintered magnet body may be obtained by coarsely milling a mother alloy containing $R^1$, Fe and B, finely pulverizing, compacting and sintering according to the standard method. It is noted that $R^1$ is one or more elements selected from Y, Sc and rare earth elements, specifically Y, Sc, La, Ce, Pr, Nd, Sm, Eu, Gd, Tb, Dy, Ho, Er, Yb, and Lu.

According to the invention, the $R^1$—Fe—B sintered magnet body is shaped to a predetermined shape as by grinding, if necessary, coated on its surface with a powder containing one or more compounds selected from an oxide, fluoride, oxyfluoride, hydroxide and hydride of $R^2$, and heat treated for causing absorption and diffusion (grain boundary diffusion) of $R^2$ into the sintered magnet body, thereby obtaining the desired rare earth magnet.

It is noted that $R^2$ is one or more elements selected from Y, Sc and rare earth elements, specifically Y, Sc, La, Ce, Pr, Nd, Sm, Eu, Gd, Tb, Dy, Ho, Er, Yb, and Lu, like $R^1$ mentioned above. It is preferred, though not limited, that $R^2$ contain at least 10 at %, more preferably at least 20 at %, and even more preferably at least 40 at % in total of Dy and/or Tb. It is more preferred in view of the object of the invention that $R^2$ contain at least 10 at % of Dy and/or Tb and the total concentration of Nd and Pr in $R^2$ be lower than the total concentration of Nd and Pr in $R^1$.

According to the invention, the application of the powder is performed by dispersing the powder in a solvent to prepare a slurry, applying the slurry to the surface of the sintered magnet body, and drying. While the particle size of the powder is not particularly limited, a particle size commonly employed as a rare earth compound powder used for absorptive diffusion (grain boundary diffusion) may be selected, and specifically, an average particle size of preferably up to 100 μm, more preferably up to 10 μm. The lower limit of particle size is preferably at least 1 nm, though not limited. The average particle size may be determined as a weight average value $D_{50}$ (i.e., particle size corresponding to a cumulative weight of 50% or median diameter) using a particle size distribution measuring system based on the laser diffraction method or the like. The solvent in which the powder is dispersed may be water or an organic solvent. Examples of the organic solvent include ethanol, acetone, methanol, and isopropyl alcohol, but are not limited thereto. Inter alia, ethanol is preferably used.

Although the amount of the powder dispersed in the slurry is not particularly limited, a slurry having the powder dispersed in a dispersing amount of preferably at least 1%, more preferably at least 10%, even more preferably at least 20% as mass fraction is used in order to coat the powder effectively and efficiently. Since too much dispersing amounts give rise to inconvenience such as failure to form a uniform dispersion, the upper limit is preferably up to 70%, more preferably up to 60%, even more preferably up to 50% as mass fraction.

In the invention, as the method of applying the slurry to the sintered magnet body and drying to coat the surface of the magnet body with the powder, a method involving using a conveyor, conveying the sintered magnet body thereby, passing the magnet body through the slurry, thereby immersing the magnet body in the slurry and coating the magnet body with the slurry is employed. During the immersion duration, the sintered magnet body is temporarily pushed up and separated apart from the conveyor belt whereby the sintered magnet body is effectively coated over the entire surfaces with the slurry. Specifically, slurry coating may be carried out using the application device shown in FIGS. 1 and 2.

Figure 2:
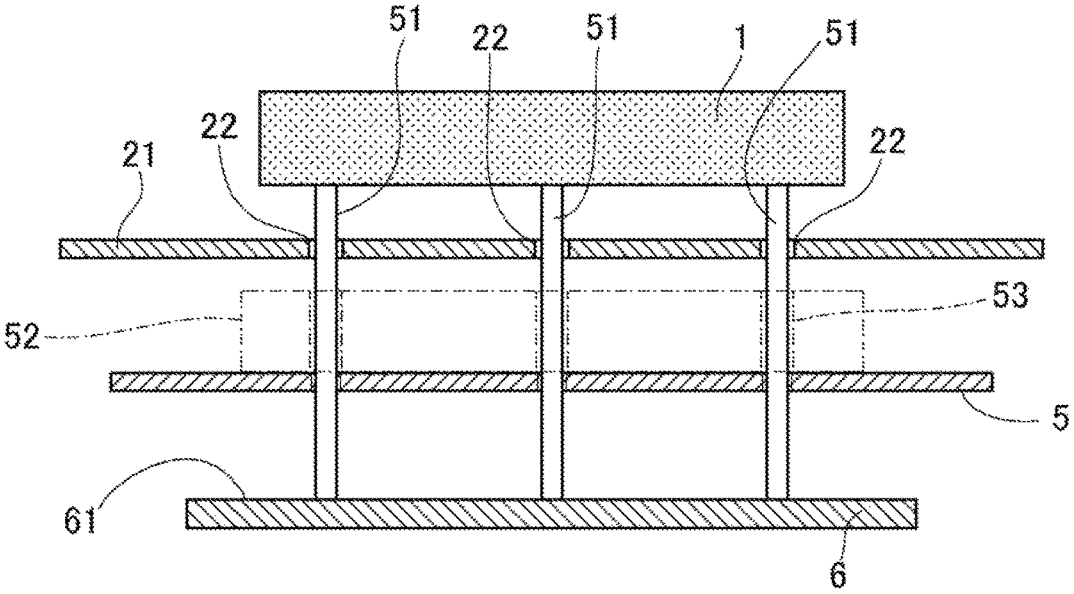
FIG. 2 is a partial cross-sectional view taken along line A-A in FIG. 1.

FIGS. 1 and 2 schematically illustrate a slurry application device in one embodiment of the invention. The application device is constructed such that a sintered magnet body 1 is conveyed by a conveyor 2 and passed through a slurry 4 contained in a coating tank 3, the magnet body 1 is immersed in the slurry 4 and coated with the slurry 4, and the magnet body 1 is withdrawn and conveyed to the subsequent steps of residual droplet removal and drying.

The conveyor 2 includes a conveyor belt 21 (reference numeral 21 designates a conveyor belt constituting the conveyor 2) for conveying the sintered magnet body 1 rested thereon in the direction of arrows in the figure (from left to right in FIG. 1). A portion of the conveyor belt 21 is moved obliquely downward, introduced into the slurry 4 in the coating tank 3, advanced horizontally through the slurry 4, moved obliquely upward, and withdrawn from the slurry 4. That is, when the sintered magnet body is conveyed by the conveyor 2, it is immersed in the slurry 4 in the coating tank 3, horizontally conveyed through the slurry 4, withdrawn from the slurry 4, and further conveyed to the subsequent steps in the course of conveyance.

The conveyor belt 21 of the conveyor 2 is perforated with a multiplicity of insertion holes 22 (see FIG. 2) such that an upper end portion of a push-up member 51 (to be described later) may protrude through the hole 22 above the belt upper surface. The insertion holes 22 are uniformly perforated in the conveyor belt 21 and circumferentially spaced apart at equal intervals. The insertion holes 22 are arranged in plural rows (three rows shown in FIG. 2, but two or four or more rows are acceptable), depending on the width of the conveyor belt 21 and sintered magnet body.

The conveyor belt 21 may be a conventional flat belt as long as it can convey the sintered magnet bodies 1 resting thereon in a steady manner and is perforated with the insertion holes 22. In the invention, a mesh belt is preferably used. The use of a mesh belt ensures effective coating of the slurry because the contact area between the belt and the magnet body 1 is reduced and the slurry 4 effectively flows across the belt.

Disposed in the coating tank 3 is a push-up belt 5 which is positioned below the conveyor belt 21 and adapted to rotate or run in the arrow direction (clockwise in FIG. 1) synchronous with the conveyor belt 21. The upper track of the push-up belt 5 extends parallel to the horizontal conveyance section of the conveyor belt 21. A plurality of column or rod-like push-up members 51 are mounted to the push-up belt 5 for vertical motion and arranged in alignment with the insertion holes 22 in the conveyor belt 21. This ensures that during progress in the upper track section parallel to the horizontal conveyance section of the conveyor belt 21, the push-up members 51 are moved up, inserted into the insertion holes 22 from below, and protruded beyond the upper surface of the conveyor belt 21.

It is noted that each push-up member 51 is adapted to move up and down over a predetermined distance and attached to the push-up belt 5 so that it may not slip from the belt 5. For example, it may be possible to prevent the push-up member 51 from slipping off by inserting the push-up member 51 into a through-hole in the push-up belt 5 and providing the push-up member 51 with an anti-slipping-off peg. Alternatively, it may be possible to prevent the push-up member 51 from slipping off by simply inserting the push-up member 51 into a through-hole in the push-up belt 5, and extending an anti-slipping-off plate 7 along the push-up belt 5 as shown by dot-and-dash line in FIG. 1.

The push-up belt 5 may also be a conventional flat belt or mesh belt as long as the push-up members 51 can be attached thereto. In consideration of flow of the slurry as in the case of the conveyor belt 21, a mesh belt is preferred. In consideration of synchronization with the conveyor belt 21, the push-up belt 5 is preferably of the same material as the conveyor belt 21.

The shape of the push-up member 51 is not particularly limited as long as it is of column or rod-like shape. Most often, the push-up member is preferably a thin rod having a diameter of 0.5 to 5 mm. Also the distal end portion of the push-up member may be bulb shaped or tapered into a smaller diameter. The insertion hole 22 in the conveyor belt 21 into which the push-up member 51 is inserted is preferably formed to a diameter larger than the outer diameter of the push-up member 51, specifically a diameter of 0.05 to 0.3 mm larger than the outer diameter of the push-up member 51, so that the push-up member 51 may be smoothly advanced. If the insertion hole is too large, it may become difficult to hold the push-up member 51 vertically, or the push-up member 51 moving in the protruded state will significantly shake, detracting from stability when the sintered magnet body 1 is pushed up as will be described later.

As shown in FIG. 1, a cam member 6 having an upper surface serving as a cam 61 is disposed inside the push-up belt 5 and below the horizontal run section of the conveyor belt 21. The upper surface of the cam member 6 is of generally angular shape of low profile, defining a cam surface 61 including a section which is slowly slanted upward along the conveyance direction of the conveyor belt 21, a horizontal section of a predetermined range, and a section which is slowly slanted downward. The lower end of each push-up member 51 attached to the push-up belt 5 rotating (or turning) in the arrow direction in FIG. 1 comes in sliding contact with the cam surface 61 and pushed up thereby. In the horizontal run section of the conveyor belt 21, the distal end of the push-up member 51 is inserted into the insertion hole 22 in the conveyor belt 21 from below, and protruded from the conveyor belt 21 to a predetermined height. The push-up member 51 is moved a certain distance in this state, and thereafter, slowly moved down, withdrawn through the insertion hole 22 in the conveyor belt 21, and retracted below. At this point, a plurality of push-up members 51 protruded above the upper surface of the conveyor belt 21 push up the sintered magnet body 1 being horizontally conveyed through the slurry 4, to separate the magnet body 1 apart from the upper surface of the conveyor belt 21 for a predetermined time, after which the magnet body 1 is rested on the conveyor belt 21 again. It is noted that the shape of the cam surface 61 may be widely changed. For example, a plurality of generally angular bulges of low profile are provided so that the push-up member 51 may be moved up and down plural times, whereby the sintered magnet body 1 is pushed up plural times.

As mentioned above, the push-up belt 5 rotates (or turns) synchronous with the conveyor belt 21. For this rotational drive, a separate drive mechanism may be provided to drive the push-up belt 5. Alternatively, since the push-up belt 5 is in meshing engagement with the conveyor belt 21 via the push-up members 51, it is possible to construct such that the push-up belt 5 is driven for rotation by the conveyor belt 21. This ensures that the push-up belt 5 is driven for rotation exactly synchronous with the conveyor belt 21 and achieves a power saving of the apparatus.

Though not limited, the push-up belt 5 may be provided with a plurality of rib or blade-shaped agitators. Then the slurry 4 in the coating tank 3 is agitated by the agitators as the push-up belt turns. For example, as shown by dot-and-dash line in FIG. 2, there is furnished an agitator member 52 in a thick plate or elongated block shape perforated with three rod insertion holes 53 corresponding to the push-up members 51. Each push-up member 51 is inserted into the rod insertion hole 53 to hold the agitator member 52 on the upper surface of the push-up belt 5 whereby the rib or blade-shaped agitator is provided on the push-up belt 5. By providing the agitator member 52 in this way, there is also obtained the effect that each push-up member 51 is effectively supported, so that the push-up member 51 is maintained in the vertical upright state. Though not shown, the push-up belt 5 may also be provided on the lower side with a member similar to the agitator member 52.

Next, the operation of coating the sintered magnet body with the slurry using the slurry application device is described.

First, the sintered magnet bodies 1 are rested on the conveyor belt 21 of the conveyor 2 at predetermined intervals and conveyed thereby. Each sintered magnet body 1 is continuously conveyed, and as shown in FIG. 1, on the way of conveyance, passed through the slurry 4 in the coating tank 3 together with the conveyor belt 21. On the other hand, in the coating tank 3, the push-up belt 5 is rotated synchronous with the conveyor belt 21 under the drive of conveying motion of the conveyor belt 21, each push-up member 51 attached to the push-up belt 5 is pushed up under the action of the cam surface 61 of the cam member 6 in the horizontal run section of the conveyor belt 21, inserted into the insertion hole 22 and protruded above the upper surface of the conveyor belt 21.

At this point when the sintered magnet body 1 is horizontally conveyed in the state immersed in the slurry 4, the magnet body 1 is pushed up by the push-up member 51 protruding above the conveyor belt 21, horizontally conveyed in the state separated apart from the conveyor belt 21 over a predetermined range (or predetermined time), rested on the conveyor belt 21 again, withdrawn from the slurry 4, and conveyed to the subsequent step by the conveyor belt 21. In the subsequent step, residual droplets are removed if necessary, and drying treatment is performed to remove the slurry solvent, leaving a coating of the powder. Notably, the residual droplet removal and drying treatment may be performed by well-known means, for example, by arranging nozzles above and below the conveyor belt 21, injecting air from the nozzles to remove residual droplets, and injecting hot air from the nozzles to dry.

As described above, the sintered magnet body 1 is continuously conveyed by the conveyor 2, immersed in the slurry 4 on the way of conveyance, and coated with the slurry. In this way, a plurality of sintered magnet bodies 1 can be continuously and automatically coated with the slurry, achieving efficient slurry coating operation. At this point, the sintered magnet body 1 during the slurry immersion duration is pushed up by the push-up members 51 and temporarily separated apart from the conveyor belt 21. At this point, the back surface portion of the sintered magnet body which has been in contact with the conveyor belt 21 comes in good contact with the slurry 4 and is thus coated with the slurry. The sintered magnet body 1 is coated over its entire surfaces with the slurry. The slurry 4 in the coating tank 3 is always agitated by the agitator members 52 provided on the rotating push-up belt 5 and thus maintained in the uniform state, ensuring uniform slurry coating. On drying, a uniform dense powder coating is formed.

Since a plurality of sintered magnet bodies are conveyed by a conveyor and continuously coated with a slurry in this way, the invention achieves efficient slurry coating and complies with mass production. When the sintered magnet body is immersed in and coated with the slurry, the sintered magnet body is temporarily pushed up and separated apart from the conveyor belt. As a result, the sintered magnet body is coated on its entire surfaces with the slurry. Accordingly, a uniform dense powder coating in tight bond can be formed, with the advantages of high efficiency and mass production.

The sintered magnet body coated with a coating of the rare earth compound powder in this way is heat treated to cause absorptive diffusion of the rare earth element $R^2$ whereby a rare earth magnet having a fully increased coercivity and improved magnetic properties is efficiently produced.

Notably, the heat treatment to cause absorptive diffusion of the rare earth element $R^2$ may be performed by a well-known method. After the heat treatment, any well-known post-treatments including aging treatment under suitable conditions and machining to a practical shape may be performed, if necessary.

EXAMPLE

Embodiments of the invention are described by referring to Example although the invention is not limited thereto.

Example 1

A thin plate of alloy was prepared by a so-called strip casting technique, specifically by weighing amounts of Nd, Al, Fe and Cu metals having a purity of at least 99 wt %, Si having a purity of 99.99 wt %, and ferroboron, high-frequency heating in argon atmosphere for melting, and casting the alloy melt on a copper single roll in argon atmosphere. The resulting alloy consisted of 14.5 at % Nd, 0.2 at % Cu, 6.2 at % B, 1.0 at % Al, 1.0 at % Si, and the balance of Fe. The alloy was exposed to 0.11 MPa of hydrogen at room temperature for hydriding, and then heated at 500° C. for partial dehydriding while evacuating to vacuum. It is cooled and sieved, obtaining a coarse powder having a size of up to 50 mesh.

On a jet mill using high-pressure nitrogen gas, the coarse powder was finely pulverized to a weight cumulative median particle size of 5 μm. The resulting fine powder was compacted in a nitrogen atmosphere under a pressure of about 1 ton/cm$^2$ while being oriented in a magnetic field of 15 kOe. The compact was then placed in a sintering furnace in argon atmosphere where it was sintered at 1,060° C. for 2 hours, obtaining a magnet block. Using a diamond cutter, the magnet block was machined on all the surfaces, cleaned with alkaline solution, pure water, nitric acid and pure water in sequence, and dried, obtaining a plate-shaped magnet body of 7 mm (W)×20.5 mm (L)×3 mm (T in magnetic anisotropy direction).

Next, dysprosium fluoride powder was mixed with water at a mass fraction of 40% and thoroughly dispersed therein to form a slurry. The coating tank 3 of the slurry application device shown in FIGS. 1 and 2 was filled with the slurry. Using the application device, the slurry was applied to the plate-shaped magnet body. Residual droplets were removed by injecting air to the slurry-coated magnet body, and the magnet body was dried by blowing dry air at 60° C., and recovered. There were obtained twenty two hundred plate-shaped magnet bodies, which were observed on their surface to inspect the coated state of dysprosium fluoride powder. As a result, no color variations indicative of uneven coating were observed on the magnet body surface.

[Coating Conditions]

(Conveyor Belt 21)

A conveyor belt of 200 mm wide was perforated over the entire surface with through-holes (insertion holes) of diameter 5 mm at a spacing of 7 mm in longitudinal and transverse directions.

(Push-Up Belt 5)

The same belt as the conveyor belt was used and provided with rods (push-up members 51) in all the through-holes. The distance between the upper surface of the push-up belt 5 and the lower surface of the conveyor belt 21 was 9 mm.

(Push-Up Member 51)

Rods of diameter 4.5 mm and 15 mm were inserted into all the through-holes of the push-up belt 5, and an anti-slipping-off plate 7 was disposed along the push-up belt 5 for preventing the rods from slipping off.

(Drive of Push-Up Belt 5)

The push-up belt 5 was synchronously rotated by the drive force of the conveyor belt 21.

(Conveying Speed)

The magnet body was conveyed at a speed of 10 mm/sec. The time of immersion in the slurry was 50 seconds, of which the time of conveyance of the magnet body lifted up by the push-up members was about 30 seconds.

(Agitator Member 52)

Thick plate-shaped agitator members 52 of 8 mm high, 7 mm thick and 200 mm wide were arranged every 3 rows of push-up members (rods) 51. As the attachment method, the agitator member 52 was held on the upper surface of the push-up belt 5 by inserting the push-up members (rods) 51 into three through-holes (diameter 5.6 mm) in the agitator member 52 as shown in FIG. 2.

Example 2

By the same method as in Example 1 aside from removing all the agitator members 52 from the application device of Example 1, 200 plate-shaped magnet bodies were coated with the slurry. On the surface of all magnet bodies, no color variations indicative of uneven coating were observed.

Comparative Example 1

By the same method as in Example 1 aside from removing the push-up members 51 from the application device of Example 1, plate-shaped magnet bodies were coated with the slurry. On 7 magnet bodies, a color variation similar to the shape of holes in the conveyor belt was observed. On 13 magnet bodies, a dot-like color variation was observed which was believed to correspond to the contact point between the belt conveyor and the plate-shaped magnet body.

REFERENCE SIGNS LIST

1 sintered magnet body
2 conveyor
21 conveyor belt
22 insertion hole
3 coating tank
4 slurry
5 push-up belt
51 push-up member
52 agitator member
53 rod insertion hole
6 cam member
61 cam surface
7 anti-slipping-off plate

The invention claimed is:

1. A method for producing rare earth magnet comprising the steps of applying a slurry of a powder in a solvent to a sintered magnet body of $R^1$—Fe—B composition, wherein $R^1$ is one or more elements selected from Y, Sc and rare earth elements, the powder containing one or more compounds selected from an oxide, fluoride, oxyfluoride, hydroxide and hydride of $R^2$ wherein $R^2$ is one or more elements selected from Y, Sc and rare earth elements, drying the slurry to coat the sintered magnet body with the powder, and heat treating the coated magnet body for causing $R^2$ to be absorbed in the sintered magnet body, the method further comprising the steps of:

providing a slurry tank filled with the slurry, a conveyor having a conveyer belt for conveying the sintered magnet body, a plurality of insertion holes perforated in the conveyer belt, and a plurality of column or rod shaped push-up members, arranging the conveyor and the plurality of column or rod shaped push-up members so that i) the conveyer belt forms a horizontal track which goes through the slurry in the slurry tank, and ii) each of the column or rod shaped push-up members is vertically arranged to move up and down through the insertion holes of the conveyor belt, and iii) the plurality of column or rod shaped push-up members are disposed under the conveyor belt and moved in a horizontal direction parallel to the horizontal track of the conveyor belt within the slurry tank, moving the conveyor belt and the plurality of column or rod shaped push-up members so that the plurality of column or rod shaped push-up members are moved in a same direction as the conveyor belt and are moved beneath the conveyor belt within the slurry tank, placing and conveying the sintered magnet body on the conveyor belt by the conveyor so as to pass through the slurry in the slurry tank, for thereby immersing the sintered magnet body in the slurry and applying the slurry to the sintered magnet body, and temporarily pushing up the sintered magnet body on the conveyor belt during the immersion duration within the slurry tank, by the plurality of column or rod shaped push-up members which protrude from the conveyor belt through the insertion holes of the conveyor belt, such that the sintered magnet body is lifted up and separated from an upper surface of the conveyor belt and then moved down onto the prior position on the upper surface of the conveyor belt without turning over.

2. The rare earth magnet producing method of claim 1 wherein the conveyor belt is a mesh belt.

3. The rare earth magnet producing method of claim 1 or 2 wherein the push-up member is a thin rod having a diameter of 0.5 to 5 mm.

4. The rare earth magnet producing method of claim 1, further comprising the step of conveying the sintered magnet body which has passed though the slurry and had the slurry applied thereto, as such by the conveyor so as to pass through a residual droplet removing zone and a drying zone in sequence for thereby removing any residual droplets on the sintered magnet body surface and drying.

5. The rare earth magnet producing method of claim 1 wherein the plurality of column or rod shaped push-up members are connected by a push-up circular belt.

6. The rare earth magnet producing method of claim 1 wherein a cam member is disposed below the conveyor belt, and the cam member is arranged so that when the push-up members are passing beneath the conveyor belt, the push-up members come in contact with the cam member, thereby pushing up the push-up members to protrude from the conveyor belt and separate the sintered magnet body from the surface of the conveyor belt.

* * * * *